US007769334B2

(12) United States Patent
Kim

(10) Patent No.: US 7,769,334 B2
(45) Date of Patent: Aug. 3, 2010

(54) FIXING UNIT AND IMAGE FORMING APPARATUS INCLUDING THE SAME

(75) Inventor: Ae Rook Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 106 days.

(21) Appl. No.: 12/141,373

(22) Filed: Jun. 18, 2008

(65) Prior Publication Data

US 2009/0092424 A1 Apr. 9, 2009

(30) Foreign Application Priority Data

Oct. 5, 2007 (KR) ..... 10-2007-0100475

(51) Int. Cl.
*G03G 15/20* (2006.01)

(52) U.S. Cl. ..... 399/329; 219/216

(58) Field of Classification Search ..... 399/328, 399/329; 219/216; 347/156
See application file for complete search history.

(56) References Cited

FOREIGN PATENT DOCUMENTS

JP 2003-195671 A * 7/2003
JP 2003-297529 10/2003

* cited by examiner

*Primary Examiner*—Sophia S Chen
(74) *Attorney, Agent, or Firm*—Staas & Halsey LLP

(57) ABSTRACT

An image forming apparatus capable of quickly heating a fixing belt with a simple configuration and stably maintaining the temperature of the fixing belt includes a fixing unit having a fixing belt, a fixing roller which supports a portion of the fixing belt and has a first heat source disposed therein, a heat transfer member which supports another portion of the fixing belt and transfers heat to the fixing belt, a pressing member which forms a fixing nip through which the fixing belt circulates, and a second heat source which is disposed outside the fixing roller and the heat transfer member and inside the fixing belt. The second heat source is disposed to heat at least two of the fixing belt, the fixing roller, and the heat transfer member.

19 Claims, 4 Drawing Sheets

FIXING UNIT AND IMAGE FORMING APPARATUS INCLUDING THE SAME

CROSS-REFERENCE TO RELATED APPLICATIONS

This application claims the benefit of Korean Patent Application No. 2007-100475, filed on Oct. 5, 2007 in the Korean Intellectual Property Office, the disclosure of which is incorporated herein by reference.

BACKGROUND OF THE INVENTION

1. Field of the Invention

Aspects of the present invention relate to an image forming apparatus, and, more particularly, to an image forming apparatus including a fixing unit having a belt to improve a fixing performance.

2. Description of the Related Art

An image forming apparatus, such as a printer, a copying machine, a fax machine, and a multifunction apparatus, forms an image on a printing medium according to an input image signal. In an electrophotographic image forming apparatus, which is a type of image forming apparatus, light is scanned onto a photosensitive member charged with a specific potential to form an electrostatic latent image on the surface of the photosensitive member, and the electrostatic latent image is supplied with toner to be developed into a toner image. The developed toner image is transferred to the printing medium, i.e., paper. The toner image is fixed on the paper by heat and pressure while passing through a fixing unit included in the image forming apparatus.

A conventional fixing unit generally includes a heating roller having a heat source therein, and a press roller which is in contact with the heating roller to form a fixing nip at a contact portion between the heating and the press rollers. Accordingly, when the paper with the toner image transferred thereto enters between the heating roller and the press roller, which are rotating, the toner image is fixed to the paper by the heat transferred from the heating roller and the pressure exerted between the heating roller and the press roller.

In the conventional fixing unit, however, since the heating roller has a large thermal capacity, a considerable time is required to heat the heating roller to a fixing temperature resulting in a long warm-up time for the fixing unit. Further, when the width of a fixing nip is expanded to improve the fixing performance, since the press roller and the heating roller have an increased diameter to increase the width of the nip, the apparatus becomes large in size.

Recently, a fixing apparatus using a belt has been proposed. FIG. 1 illustrates a cross-sectional view showing a configuration of a conventional belt-type fixing unit. As shown in FIG. 1, generally, the conventional belt-type fixing unit includes a fixing belt 3, which has an inner surface supported by a first roller 1 and a second roller 2, that circulates and moves about the first and second rollers 1 and 2, and a press roller 4, which is pressed against the first roller 1 and the second roller 2 while the fixing belt 3 is disposed therebetween. A heat source 5 is installed on at least one of the first roller 1 and the second roller 2, which support the fixing belt 3, to thereby heat the fixing belt 3.

According to the above-mentioned belt-type fixing unit, it is possible to ensure a large width of the fixing nip between the fixing belt and the press roller, thereby improving the fixing performance, while maintaining a small size of the fixing unit. Further, since a fixing belt having a relatively low thermal capacity is used as a medium which transfers heat to the paper, it is possible to reduce the warm-up time some extent.

However, in the above-mentioned belt-type fixing unit, since it takes quite a time to increase a whole area of the fixing belt, which circulates and moves between the rollers, to the required fixing temperature, such a fixing unit has a limit in reducing the warm-up time. Further, the fixing belt loses heat to the paper or the surrounding air, and the temperature of the fixing belt rapidly decreases in the circulation process. In this case, since heat is not quickly supplied to the fixing belt, there is a problem of causing a fixing failure due to a decrease in the temperature of the fixing belt. Particularly, the problem is accelerated speed of image forming increases.

To overcome such limits of the belt-type fixing unit, Japanese Patent Laid-open Publication No. 2003-297529 discloses a belt-type fixing unit wherein heat sources are installed inside both the first and second rollers, which support the fixing belt, and an induction heating element or a planar heating element is installed to locally heat a contact portion between the fixing belt and the paper or air. According to the fixing unit disclosed therein, it is possible to quickly heat the fixing belt by the heat sources installed in the two rollers or the heating element installed between the rollers. However, the fixing unit disclosed therein has a problem of large power consumption because a number of heat sources are used to quickly heat the fixing belt and maintain the temperature. Further, it is difficult to manufacture a small-sized fixing unit due to a complicated inner configuration of the fixing unit. Moreover, in the fixing unit disclosed therein, since two rollers are used to support the fixing belt, when the fixing belt is extended due to an increase in the temperature of the fixing belt, there is a large possibility of causing a jam or an image defect due to meandering or corrugation of the belt.

SUMMARY OF THE INVENTION

Aspects of the present invention provide an improved image forming apparatus capable of quickly heating a fixing belt with a simple configuration and stably maintaining the temperature of the fixing belt. Aspects of the invention provide an image forming apparatus capable of reducing thermal expansion of the fixing belt.

According to aspects of the present invention, an image forming apparatus includes a fixing unit, the fixing unit including: a fixing roller in which a first heat source is disposed; a heat transfer member disposed adjacent to the fixing roller; a second heat source disposed adjacent to the fixing roller and the heat transfer member; a fixing belt disposed to circulate and move about the fixing roller, the heat transfer member, and the second heat source; and a pressing member disposed to form a fixing nip at least between the fixing roller and the pressing member such that the fixing belt circulates and moves through the fixing nip.

According to aspects of the present invention, the second heat source heats at least two of the fixing belt, the fixing roller, and the heat transfer member. According to aspects of the present invention, the second heat source is disposed between the heat transfer member and the fixing roller. According to aspects of the present invention, the second heat source may be disposed between the heat transfer member and the fixing belt. According to aspects of the present invention, the second heat source may be disposed to be surrounded by the fixing belt, the fixing roller, and the heat transfer member. According to aspects of the present invention, the second heat source radiantly heats a portion of the fixing belt corresponding to the fixing nip.

According to aspects of the present invention, the heat transfer member includes a nip forming portion to form at least a portion of the fixing nip with the pressing member, and a belt heating portion which is in contact with an inner surface of the fixing belt to heat the fixing belt. According to aspects of the present invention, the belt heating portion may extend to a point adjacent to the fixing roller from the nip forming portion.

According to aspects of the present invention, the fixing roller includes a nip forming portion to form at least a portion of the fixing nip with the pressing member, and the nip forming portion of the heat transfer member extends to a point adjacent to the nip forming portion of the fixing roller. According to aspects of the present invention, the second heat source may be disposed between the nip forming portion of the heat transfer member, the belt heating portion of the heat transfer member, and the fixing roller.

According to aspects of the present invention, the heat transfer member has a heat transmission portion such that heat emitted from the second heat source passes through the heat transfer member to reach the fixing belt. According to aspects of the present invention, the heat transfer member is formed of a metal material.

According to aspects of the present invention, an image forming apparatus includes a fixing unit, the fixing unit including: a fixing belt; a fixing roller in which a first heat source is disposed; a heat transfer member to transfer heat to the fixing belt; a second heat source to heat the heat transfer member; and a pressing member disposed to form a fixing nip with at least the fixing roller through which the fixing belt moves, wherein the fixing belt circulates and moves about the fixing roller, the heat transfer member, and the second heat source, and the fixing belt includes a first heating target portion, which is heated while in contact with the fixing roller, a second heating target portion, which is directly heated by radiant heat of the second heat source, and a third heating target portion, which is heated while in contact with the heat transfer member.

According to aspects of the present invention, any two of the first to the third heating target portions are adjacent to each other. According to aspects of the present invention, the second heat source radiantly heats at least two of the fixing belt, the fixing roller, and the heat transfer member.

According to aspects of the present invention, the heat transfer member includes a nip forming portion to form at least a portion of the fixing nip with the pressing member, and a belt heating portion which extends to a point adjacent to the fixing roller from the nip forming portion of the heat transfer member and contacts an inner surface of the fixing belt.

According to aspects of the present invention, the nip forming portion of the heat transfer member extends from an end of the fixing nip to a point adjacent to the fixing roller.

According to aspects of the present invention, the fixing roller includes a nip forming portion to form at least a portion of the fixing nip with the pressing member, and the second heating target portion is positioned between the nip forming portion of the fixing roller, and the nip forming portion of the heat transfer member.

According to aspects of the present invention, it is possible to efficiently heat the fixing belt through the second heat source which emits heat in all directions and the heat transfer member which is heated by the second heat source and transfers the heat to the fixing belt. According to aspects of the present invention, it is possible to reduce a warm-up time of the image forming apparatus by quickly heating the fixing belt, and it is also possible to improve the fixing performance by stably maintaining the temperature of the fixing belt.

According to aspects of the present invention, it is possible to reduce thermal expansion of the fixing belt by employing the heat transfer member which supports the fixing belt over a large width.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the exemplary embodiments of the invention will become apparent and more readily appreciated from the following description of the embodiments, taken in conjunction with the accompanying drawings, of which.

DETAILED DESCRIPTION OF THE EMBODIMENTS

Figure 1:
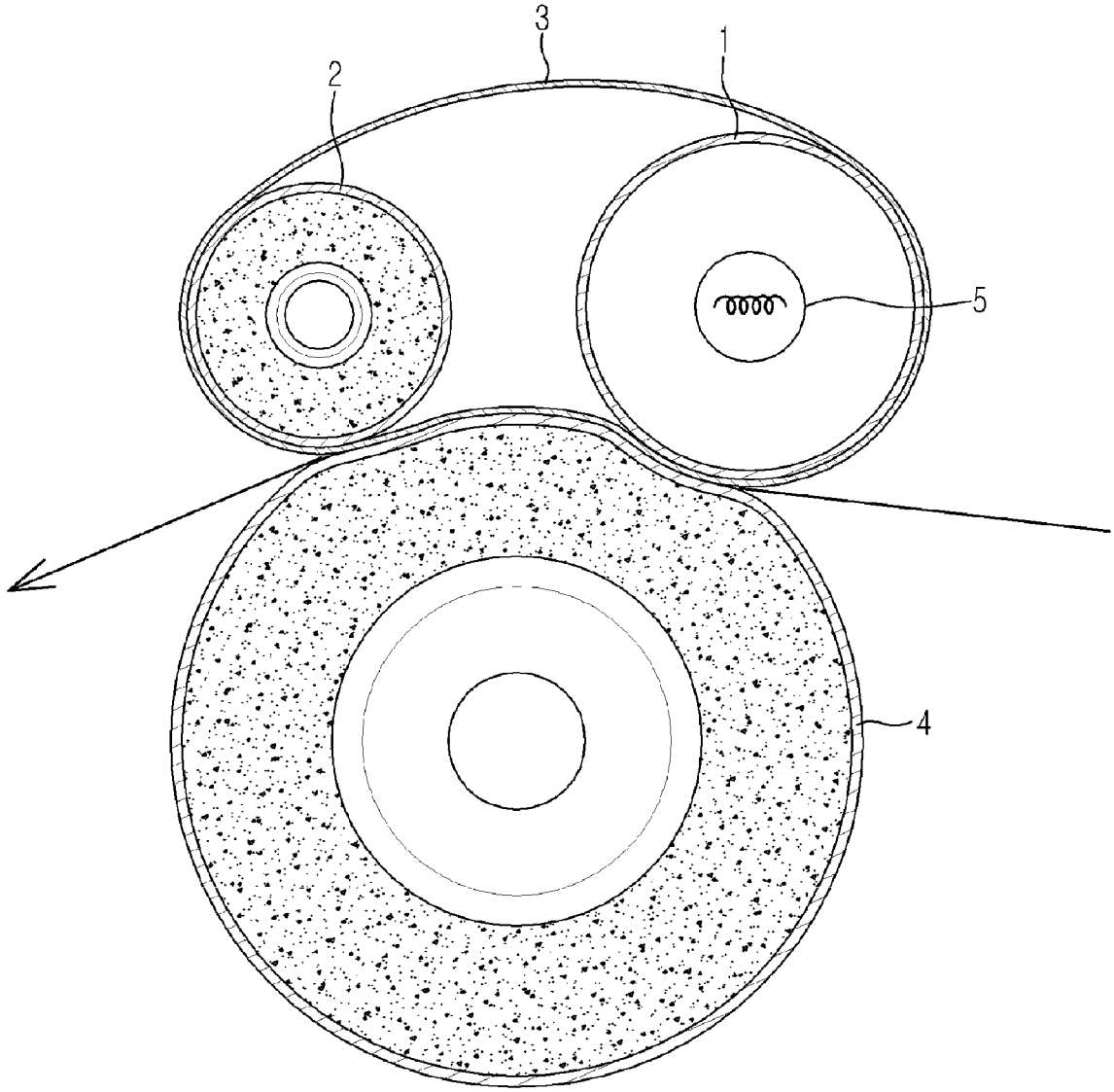
FIG. 1 (Related Art)
FIG. 1 is a cross-sectional view showing a configuration of a conventional belt-type fixing unit.

Reference will now be made in detail to exemplary embodiments of the present invention, examples of which are illustrated in the accompanying drawings, wherein like reference numerals refer to like elements throughout. The embodiments are described below to explain the aspects of the present invention by referring to the figures.

Figure 2:
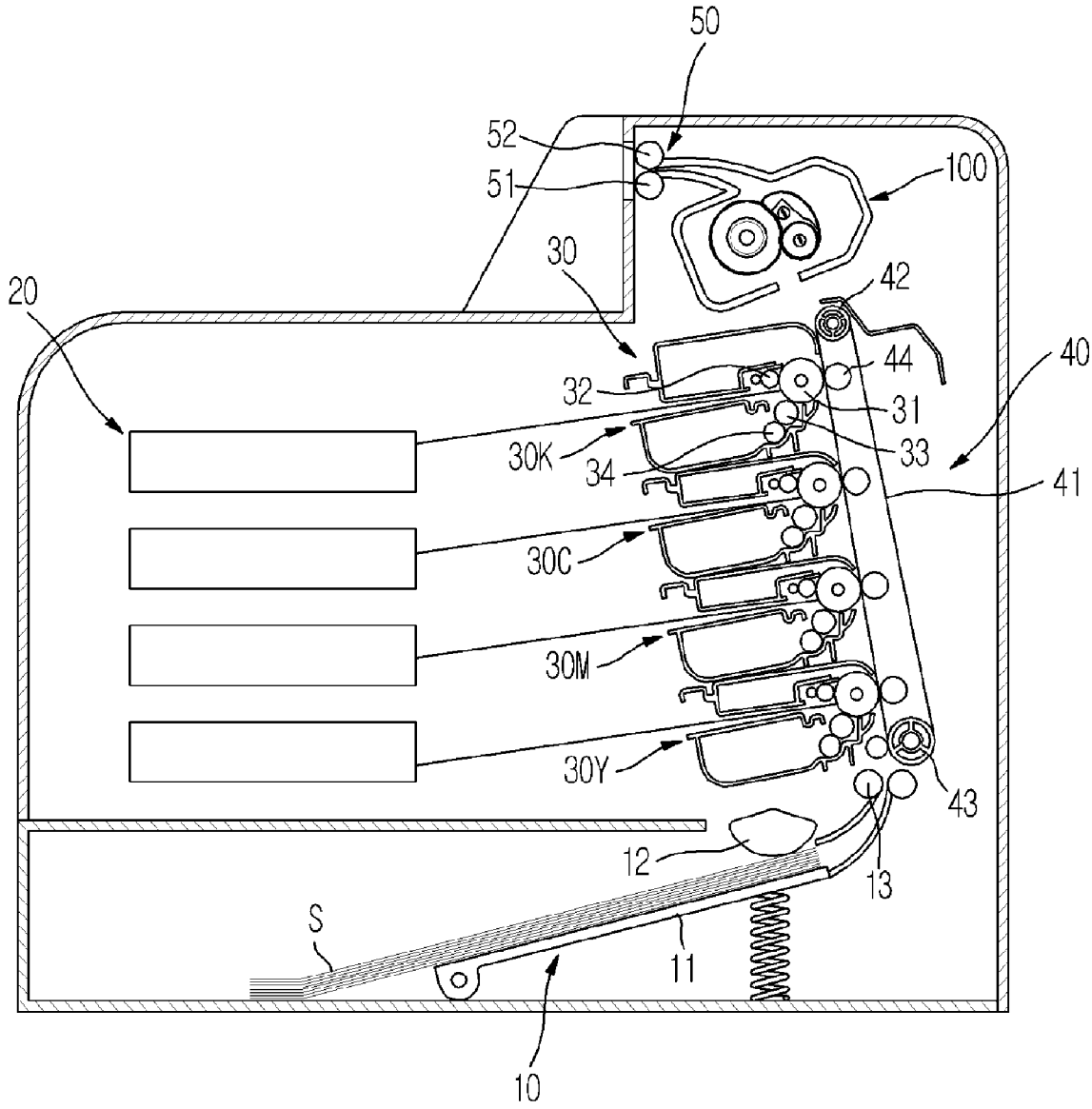
FIG. 2 is a cross-sectional view showing a configuration of an image forming apparatus according to aspects of the present invention.

FIG. 2 is a cross-sectional view showing a configuration of an image forming apparatus according to aspects of the present invention. As shown in FIG. 2, the image forming apparatus according to aspects of the present invention includes a paper supply unit 10, light scanning units 20, a developing unit 30, a transfer unit 40, a fixing unit 100, and a paper discharge unit 50.

The paper supply unit 10 supplies paper S to a developing unit 30. The paper S may be any type of printing medium, such as, printing paper, wallpaper, transparencies, cardboard, and/or the like, and the paper supply unit 10 may supply any type of printing medium to the developing unit 30. The paper supply unit 10 includes a paper tray 11 on which the paper S is loaded, and a pickup roller 12, which picks up the paper S loaded on the paper tray 11 sheet by sheet. The paper S picked up by the pickup roller 12 is fed to the developing unit 30 by a feed roller 13.

The developing unit 30 includes four developers 30Y, 30M, 30C, and 30K which contain different colors of toner, for example, yellow (Y), magenta (M), cyan (C), and black (K), respectively. The developers 30Y, 30M, 30C, and 30K include photosensitive members 31 on which electrostatic latent images are formed by the light scanning units 20, respectively. The light scanning units 20 irradiate light corresponding to image information of the colors of yellow (Y), magenta (M), cyan (C), and black (K) to the photosensitive members 31 according to printing signals.

Each of the developers 30Y, 30M, 30C and 30K includes a charge roller 32, which charges each of the photosensitive members 31; a developing roller 33, which develops the electrostatic latent image formed on the photosensitive member 31 into a toner image; and a supply roller 34, which supplies toner to the developing roller 33.

The transfer unit 40 transfers the toner images developed on the photosensitive members 31 onto the paper S. The transfer unit 40 includes a transfer belt 41, which is in contact with the photosensitive members 31 to circulate and move the picked up paper S; a transfer belt driving roller 42, which drives the transfer belt 41; a tension roller 43, which maintains a uniform tension of the transfer belt 41; and four transfer rollers 44 which transfer the toner images developed on the photosensitive members 31 onto the paper.

The fixing unit 100 fixes the toner images transferred to the paper by the transfer unit 40 on the paper S. The fixing unit 100 will be described later in detail.

Meanwhile, the paper discharge unit 50 discharges the printed paper to the outside of the image forming apparatus. The paper discharge unit 50 includes a paper discharge roller 51 and a paper discharge backup roller 52, which is installed to face the paper discharge roller 51.

Figure 3:
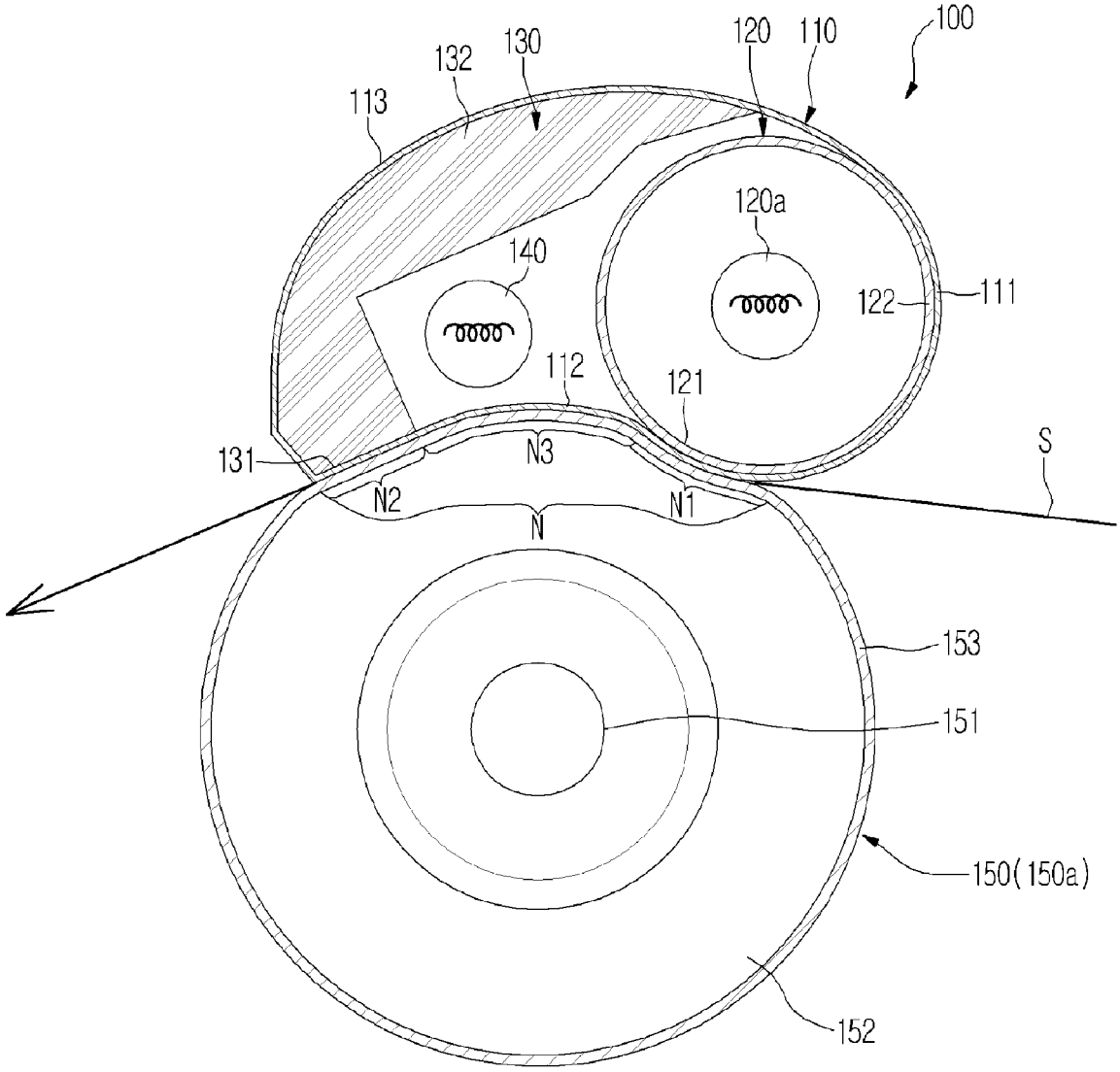
FIG. 3 is a cross-sectional view showing a configuration of a fixing unit according to aspects of the present invention.

FIG. 3 is a cross-sectional view showing a configuration of a fixing unit according to a first embodiment of the present invention. As shown in FIG. 3, the fixing unit 100 includes a fixing belt 110, which is installed to circulate and move; a fixing roller 120, which has a first heat source 120*a* installed therein; a heat transfer member 130, which transfers heat to the fixing belt 110, a second heat source 140, which heats peripheral parts inside the fixing belt 110, and a pressing member 150 facing the fixing belt 110 and which forms a fixing nip N. The paper S with the transferred toner images passes through the fixing nip N between the pressing member 150 and the fixing belt 110. In this case, the toner images are fixed on the paper by heat and pressure.

The pressing member 150 is pressed toward the fixing belt 110 to form the fixing nip N. The pressing member 150 may be configured as a press roller 150*a*. The press roller 150*a* may includes a shaft 151, which is made of a metal material, such as aluminum or steel; and an elastic layer 152, which is installed to cover the shaft 151 and is elastically deformed as the press roller 150*a* is pressed to toward the fixing belt 110. The elastic layer 152 is generally formed of a silicon rubber. A release layer 153 may be disposed on the surface of the elastic layer 152 to prevent the paper S from being adhered to the press roller 150*a*.

The fixing belt 110 is supported by the fixing roller 120 and the heat transfer member 130. As the fixing roller 120 rotates, the fixing belt 110 circulates and moves around the fixing roller 120 and the heat transfer member 130. The fixing belt 110 has a width corresponding to a length of the pressing member 150 and is engaged with the pressing member 150 to form the fixing nip N with the pressing member 150. Further, the fixing belt 110 is formed of a heat resistant material. The fixing belt 110 is heated by the first heat source 120*a* and the second heat source 140 installed therein to transfer heat to the paper S, which is passing through the fixing nip N.

According to aspects of the present invention, the fixing belt 110 includes a first heating target portion 111, which is heated while in contact with the fixing roller 120; a second heating target portion 112, which is radiantly heated directly by the second heat source 140; and a third heating target portion 113, which is heated while in contact with the heat transfer member 130.

The fixing belt 110 may be heated in all possible regions through the first to the third heating target portions 111, 112, and 113. Accordingly, it is possible to reduce a warm-up time by quickly heating the fixing belt 110 and also possible to prevent a fixing performance from being reduced as the temperature of the fixing belt 110 decreases in a fixing process due to circulation of the fixing belt 110.

For this, any two portions of the first to the third heating target portions 111, 112, and 113 are positioned adjacent to each other. As shown in FIG. 3, one side of the first heating target portion 111 is adjacent to the second heating target portion 112, and the other side of the first heating target portion 111 is adjacent to the third heating target portion 113. Further, one side of the third heating target portion 113 is adjacent to the second heating target portion 112, and the other side of the third heating target portion 113 is adjacent to the first heating target portion 111.

The fixing roller 120 is installed inside the fixing belt 110 to support a portion of the fixing belt 110. The fixing roller 120 is formed of a cylindrical member may be made of iron or aluminum or a material having a similarly excellent thermal conductivity. The first heat source 120*a* is installed inside the fixing roller 120. A halogen lamp may be used as the first heat source 120*a*. The fixing roller 120 is heated by the first heat source 120*a*. The heated fixing roller 120 heats the first heating target portion 111 of the fixing belt 110.

The fixing roller 120 includes a nip forming portion 121, which is pressed by the press roller 150*a*, and a belt heating portion 122, which is in contact with the first heating target portion 111 of the fixing belt 110 in a region excluding the nip forming portion 121. A first fixing nip portion N1 is defined between the nip forming portion 121 of the fixing roller 120 and the pressing member 150, i.e., the press roller 150*a*.

Meanwhile, the fixing roller 120 may also drive the circulation of the fixing belt 110. When the fixing roller 120 rotates, the fixing belt 110 disposed about the fixing roller 120 circulates and moves, and the press roller 150*a* engaged with the fixing roller 120 rotates. However, aspects of the present invention are not limited thereto such that the press roller 150*a* may rotate so as to drive the fixing belt 110 while the fixing roller 120 rotates or not.

The heat transfer member 130 is installed inside the fixing belt 110 to support another portion of the fixing belt 110. The heat transfer member 130 is heated by the second heat source 140 and the heated heat transfer member 130 heats the third heating target portion 113 of the fixing belt 110. The heat transfer member 130 is preferably formed of a metal material having high thermal conductivity.

The heat transfer member 130 includes a nip forming portion 131, which is pressed by the press roller 150*a*, and a belt heating portion 132, which is in contact with the third heating target portion 113 of the fixing belt 110 in a region excluding the nip forming portion 131. A second fixing nip portion N2 is defined between the nip forming portion 131 of the heat transfer member 130 and the press roller 150*a*.

The nip forming portion 131 and the belt heating portion 132 of the heat transfer member 130 are in contact with an inner surface of the fixing belt 110 to heat the fixing belt 110. The belt heating portion 132 of the heat transfer member 130 can be extended to a point adjacent to the fixing roller 120 from the nip forming portion 131. As described above, when the belt heating portion 132 is extended to a point adjacent to the fixing roller 120, the fixing belt 110 is continuously heated by the heat transfer member 130 in a section between the second fixing nip portion N2 and the fixing roller 120, i.e., the heating target portion 111 of the fixing belt 110, in a moving direction of the fixing belt 110. Accordingly, it is possible to prevent the temperature of the fixing belt 110 from being rapidly reduced as the fixing belt 110 loses heat to the surrounding air. Also, it is possible to more quickly heat the fixing belt 110.

Further, since the heat transfer member 130 supports the fixing belt 110 over a large area, even when the fixing belt 110 is thermally expanded, a meandering phenomenon of the belt is substantially decreased. Further, since the heat transfer member 130 is expanded as the temperature increases, it is possible to prevent a reduction in tension of the fixing belt 110 due to thermal expansion of the fixing belt 110.

As shown in FIG. 3, the second heat source 140 is disposed at the outside of the fixing roller 120 and the heat transfer member 130 and inside the fixing belt 110. The second heat source 140 emits heat in all directions to heat at least two of the fixing belt 110, the fixing roller 120, and the heat transfer member 130. The second heat source 140 may be a halogen lamp, but it is not limited thereto.

The second heat source 140 is disposed between the heat transfer member 130 and the fixing belt 110 to radiantly heat a portion corresponding to a third fixing nip portion N3 between the heat transfer member 130 and the fixing belt 110, i.e., a second heating target portion 112. In this case, the third fixing nip portion N3 refers to a portion of the fixing nip N between the first fixing nip N1 and the second fixing nip N2.

Further, the second heat source 140 is disposed between the heat transfer member 130 and the fixing roller 120 to radiantly heat the heat transfer member 130 and also radiantly heat the fixing roller 120 at the outside of the fixing roller 120. Although the fixing roller 120 is mainly heated by the first heat source 120*a* installed therein, the second heat source 140 additionally heats a portion of the fixing roller 120 in contact with air to prevent a reduction in the temperature of the fixing roller 120. The second heat source 140 may also heat a portion of the fixing belt 110 disposed in the second heating target portion 112 (the portion of the fixing belt 110 disposed in the third fixing nip portion N3).

FIG. 3 illustrates an example in which the second heat source 140 is disposed to be surrounded by the fixing belt 110, the fixing roller 120, and the heat transfer member 130 to heat the fixing belt 110, the fixing roller 120, and the heat transfer member 130. However, the second heat source 140 may heat only any two parts of the fixing belt 110, the fixing roller 120, and the heat transfer member 130 by changing a shape of the heat transfer member 130 or employing an additional reflective member.

Hereinafter, operations of the fixing unit 100 and the image forming apparatus according to aspects of the present invention are explained with reference to FIGS. 2 and 3. When a power is applied to the image forming apparatus, the fixing belt 110 is heated to a temperature appropriate for performing a fixing operation by the first heat source 120*a* and the second heat source 140 of the fixing unit 100.

The first heat source 120*a* heats the fixing roller 120 inside the fixing roller 120, and the second heat source 140 heats the fixing roller 120 outside the fixing roller 120. The heated fixing roller 120 is in contact with the fixing belt 110 at the nip forming portion 121 and a belt heating portion 122 of the fixing roller 120, i.e., the first heating target portion 111 of the fixing belt 110, to transfer heat to the fixing belt 110.

Further, the second heat source 140 heats the heat transfer member 130 and the heated heat transfer member 130 transfers heat to the fixing belt 110 through the nip forming portion 131 and the belt heating portion 132, i.e., the third heating target portion 113. Further, the second heat source 140 directly and radiantly heats the fixing belt 110 at a portion corresponding to the third fixing nip portion N3, i.e., the second heating target portion 112.

As described above, the fixing belt 110 is heated by the fixing roller 120 and the heat transfer member 130. Also, the fixing belt 110 is directly heated by the second heat source 140. Accordingly, it is possible to quickly increase the temperature of the fixing belt 110.

When the fixing belt 110 is heated to an appropriate temperature through the above process, a printing operation is started according to a command of the user. That is, electrostatic latent images corresponding to image information are formed on the surfaces of the photosensitive members 31 by the light scanning units 20. The developing unit 30 supplies toner on the photosensitive members 31 to develop the electrostatic latent images into toner images. Meanwhile, the paper S is supplied by the paper supply unit 10 and the transfer unit 40 transfers the toner images of the photosensitive members 31 on the paper S.

As described above, the paper S with the transferred toner images passes between the press roller 150*a* and the fixing belt 110 in the fixing unit 100. In this case, the toner images of the paper S are fixed on the paper S by heat transferred from the fixing belt 110 and pressure exerted between the press roller 150*a* and the fixing belt 110.

In this process, as the fixing belt 110 transfers heat to the paper S, the temperature of the fixing belt 110 decreases. However, the fixing belt 110 is directly heated by the second heat source 140 in the third fixing nip part of the fixing nip N. Further, while the fixing belt 110 circulates, the fixing belt 110 is continuously heated by the heat transfer member 130 and the fixing roller 120 to stably maintain the temperature thereof and fix the transferred toner image to the paper S, which is then output by the paper discharge unit 50.

Figure 4:
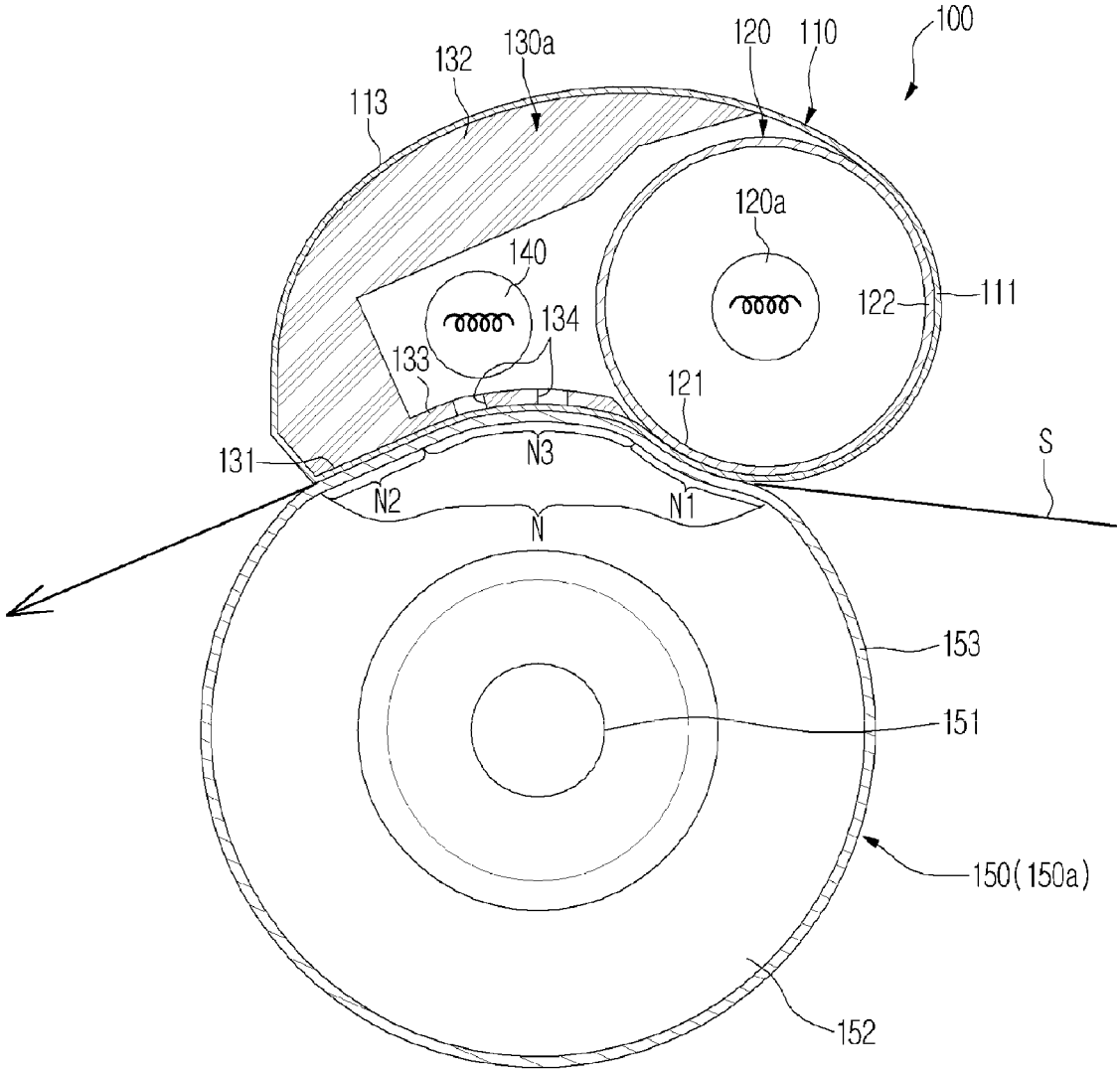
FIG. 4 is a cross-sectional view showing a configuration of a fixing unit according to aspects of the present invention.

FIG. 4 illustrates a cross-sectional view showing a configuration of a fixing unit according to a second embodiment of the present invention. The second embodiment relates to an example in which the shape of the heat transfer member is changed. Hereinafter, only features of the second embodiment are explained, and the same components as those shown in FIG. 3 are designated by the same reference numerals.

As shown in FIG. 4, the nip forming portion 131 of a heat transfer member 130*a* may include an extended portion 133 extending to a point adjacent to the nip forming portion 121 of the fixing roller 120. Accordingly, the fixing belt 110 is supported by the heat transfer member 130*a* over a large width, i.e., over a large portion of the fixing nip N, to firmly form the fixing nip N, thereby improving the fixing performance.

The second heat source 140 is disposed between the extended portion 133 and the belt heating portion 132 of the heat transfer member 130*a* and between the fixing roller 120 and the heat transfer member 130*a* to heat the heat transfer member 130*a* and the fixing roller 120.

The fixing belt 110 is heated at a point corresponding to the third fixing nip portion N3 by heat transferred from the extended portion 133 of the heat transfer member 130*a*. Preferably, the heat transfer member 130*a* has a heat transmission portion 134 such that heat emitted from the second heat source 140 passes through the heat transmission portion 134 of the extended portion 133 to directly heat the fixing belt 110.

Although embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus having a fixing unit, the fixing unit comprising:

a fixing roller in which a first heat source is disposed;

a heat transfer member disposed adjacent to the fixing roller;

a second heat source disposed adjacent to the fixing roller and the heat transfer member;

a fixing belt disposed to circulate about the fixing roller, the heat transfer member, and the second heat source; and a pressing member disposed to form a fixing nip at least between the fixing roller and the pressing member such that the fixing belt moves through the fixing nip, wherein the second heat source is disposed between the heat transfer member and the fixing belt, and the second heat source radiantly heats a portion of the fixing belt corresponding to the fixing nip.

2. The image forming apparatus of claim 1, wherein the second heat source is disposed to be surrounded by the fixing belt, the fixing roller, and the heat transfer member.

3. The image forming apparatus of claim 1, wherein the heat transfer member is formed of a metal material.

4. An image forming apparatus having a fixing unit, the fixing unit comprising:

a fixing roller in which a first heat source is disposed;

a heat transfer member disposed adjacent to the fixing roller;

a second heat source disposed adjacent to the fixing roller and the heat transfer member;

a fixing belt disposed to circulate about the fixing roller, the heat transfer member, and the second heat source; and a pressing member disposed to form a fixing nip at least between the fixing roller and the pressing member such that the fixing belt moves through the fixing nip, wherein the heat transfer member comprises:

a nip forming portion to form at least a portion of the fixing nip with the pressing member; and a belt heating portion which is in contact with an inner surface of the fixing belt to heat the fixing belt.

5. The image forming apparatus of claim 4, wherein the belt heating portion extends to a point adjacent to the fixing roller from the nip forming portion.

6. The image forming apparatus of claim 4, wherein the fixing roller includes a nip forming portion to form at least a portion of the fixing nip with the pressing member, and the nip forming portion of the heat transfer member extends to a point adjacent to the nip forming portion of the fixing roller, and wherein the second heat source is disposed between the nip forming portion of the heat transfer member, the belt heating portion of the heat transfer member, and the fixing roller.

7. An image forming apparatus having a fixing unit, the fixing unit comprising:

a fixing roller in which a first heat source is disposed;

a heat transfer member disposed adjacent to the fixing roller;

a second heat source disposed adjacent to the fixing roller and the heat transfer member;

a fixing belt disposed to circulate about the fixing roller, the heat transfer member, and the second heat source; and a pressing member disposed to form a fixing nip at least between the fixing roller and the pressing member such that the fixing belt moves through the fixing nip, wherein the heat transfer member comprises a heat transmission portion such that heat emitted from the second heat source passes through the heat transfer member to heat the fixing belt.

8. An image forming apparatus having a fixing unit, the fixing unit comprising:

a fixing belt;

a fixing roller in which a first heat source is disposed;

a heat transfer member to transfer heat to the fixing belt;

a second heat source to heat the heat transfer member; and a pressing member disposed to form a fixing nip with at least the fixing roller through which the fixing belt moves, wherein the fixing belt circulates about the fixing roller, the heat transfer member, and the second heat source, and the fixing belt includes a first heating target portion, which is heated while in contact with the fixing roller, a second heating target portion, which is heated by radiant heat of the second heat source, and a third heating target portion, which is heated while in contact with the heat transfer member, and the heat transfer member comprises a nip forming portion to form at least a portion of the fixing nip with the pressing member; and a belt heating portion which extends to a point adjacent to the fixing roller from the nip forming portion of the heat transfer member and contacts an inner surface of the fixing belt.

9. The image forming apparatus of claim 8, wherein any two of the first to the third heating target portions are adjacent to each other.

10. The image forming apparatus of claim 8, wherein the second heat source radiantly heats at least two of the fixing belt, the fixing roller, and the heat transfer member.

11. The image forming apparatus of claim 8, wherein the nip forming portion of the heat transfer member extends from an end of the fixing nip to a point adjacent to the fixing roller.

12. The image forming apparatus of claim 8, wherein the fixing roller includes a nip forming portion to form at least a portion of the fixing nip with the pressing member, and the second heating target portion is positioned between the nip forming portion of the fixing roller and the nip forming portion of the heat transfer member.

13. The image forming apparatus of claim 8, wherein the second heating target portion is directly heated by radiant heat of the second heat source.

14. An image forming apparatus having a fixing unit, the fixing unit comprising:

a fixing belt;

a fixing roller in which a first heat source is disposed;

a heat transfer member to transfer heat to the fixing belt;

a second heat source to heat the heat transfer member; and a pressing member disposed to form a fixing nip with at least the fixing roller through which the fixing belt moves, wherein the fixing belt circulates about the fixing roller, the heat transfer member, and the second heat source, and the fixing belt includes a first heating target portion, which is heated while in contact with the fixing roller, a second heating target portion, which is heated by radiant heat of the second heat source, and a third heating target portion, which is heated while in contact with the heat transfer member, and a portion of the heat transfer member extends from an end of the fixing nip toward the fixing roller adjacent to the second heating target portion of the fixing belt.

15. The image forming apparatus of claim 14, wherein the portion of the heat transfer member extending from the end of the fixing nip toward the fixing roller comprises heat transmission portions extending therethrough so that the fixing belt is heated directly by the second heat source.

16. The image forming apparatus of claim 13, wherein the fixing belt is heated by heat transferred from the second heat source to the fixing belt via the portion of the heat transfer member extending from the end of the fixing nip toward the fixing roller.

17. A fixing unit for an image forming apparatus, the fixing unit comprising:

a fixing roller in which a first heat source is disposed to heat the fixing roller;

a heat transfer member disposed adjacent to the fixing roller;

a fixing belt disposed to circulate about the about the fixing roller and the heat transfer member;

a pressing roller disposed to form a fixing nip with the fixing roller and the heat transfer member through which the fixing belt moves; and a second heat source disposed to heat the fixing belt, the heat transfer member at a portion thereof not in contact with the fixing belt, and the fixing roller at a portion thereof not in contact with the fixing belt, wherein the second heat source is disposed between the heat transfer member and the fixing belt, and the second heat source radiantly heats a portion of the fixing belt corresponding to the fixing nip.

18. The fixing unit of claim 17, wherein at least one of the fixing roller and the pressing roller rotates to circulate and move the fixing belt about the fixing roller, the heat transfer member, and the second heat source.

19. The fixing unit of claim 17, wherein the heat transfer member is disposed to support a portion of the fixing belt not in contact with the fixing roller.

* * * * *